US005601154A

United States Patent [19]

Eisenmenger

[11] Patent Number: 5,601,154

[45] Date of Patent: Feb. 11, 1997

[54] PORTABLE SUSPENDED ROOF SCAFFOLD SYSTEM

[76] Inventor: Gary W. Eisenmenger, 4503 Fox Run Rd., Louisville, Ky. 40207

[21] Appl. No.: 228,182

[22] Filed: Apr. 13, 1994

Related U.S. Application Data

[63] Continuation-in-part of Ser. No. 103,454, Aug. 6, 1993.

[51] Int. Cl.[6] ..... E06C 7/14

[52] U.S. Cl. ..... 182/45; 182/206

[58] Field of Search ..... 182/45, 206, 214, 182/120, 117

[56] References Cited

U.S. PATENT DOCUMENTS

| | | | |
|---|---|---|---|
| 3,115,211 | 12/1963 | Ostrander, Jr. | 182/214 X |
| 3,606,226 | 9/1971 | Bell, Sr. . | |
| 3,842,934 | 10/1974 | Bartlett | 182/37 |
| 3,853,202 | 12/1974 | Jarboe | 182/214 X |
| 3,866,715 | 2/1975 | Foulk | 182/45 |
| 3,899,045 | 4/1975 | Geisel et al. | 182/121 |
| 4,085,819 | 4/1978 | Ohnstad | 182/121 |
| 4,232,759 | 11/1980 | Jacobs | 182/39 |
| 4,306,700 | 12/1981 | Bell | 248/238 |
| 4,311,207 | 1/1982 | Lurry | 182/206 |
| 4,398,620 | 8/1983 | Townsend | 182/45 |
| 4,425,985 | 1/1984 | Geisel et al. | 182/121 |
| 4,542,874 | 9/1985 | Rönning | 248/238 |
| 4,546,853 | 10/1985 | Hanson | 182/103 |
| 4,616,734 | 10/1986 | Phelps | 182/45 |
| 4,618,030 | 10/1986 | Campbell | 182/121 |
| 4,646,877 | 3/1987 | Whan | 182/38 |
| 4,676,341 | 6/1987 | Shaffstall | 182/45 |
| 4,695,023 | 9/1987 | McCafferty | 248/238 |
| 4,785,606 | 11/1988 | Burton | 182/45 X |
| 4,800,988 | 1/1989 | Dunmore | 182/103 |
| 4,828,073 | 5/1989 | Friday | 182/36 |
| 4,856,745 | 8/1989 | Mabie | 248/237 |
| 4,911,265 | 3/1990 | Skaggs | 182/121 |
| 4,938,312 | 7/1990 | Trail | 182/214 X |
| 4,941,547 | 7/1990 | Livick | 182/107 |
| 4,957,185 | 9/1990 | Courchesne et al. | 182/150 |
| 4,972,922 | 11/1990 | Levine | 182/45 |
| 4,972,923 | 11/1990 | Krause | 182/121 |
| 5,020,757 | 6/1991 | Sulecki et al. | 248/238 |
| 5,031,722 | 7/1991 | Renaud | 182/117 |
| 5,143,170 | 9/1992 | Hunt et al. | 182/3 |

FOREIGN PATENT DOCUMENTS

| | | | |
|---|---|---|---|
| 117066 | 8/1984 | European Pat. Off. | 182/45 |
| 3445682 | 6/1986 | Germany | 182/45 |
| 1604041 | 12/1981 | United Kingdom | 182/45 |
| 2201716 | 9/1988 | United Kingdom | 182/45 |

*Primary Examiner*—Alvin C. Chin-Shue

*Attorney, Agent, or Firm*—Senniger, Powers, Leavitt & Roedel

[57] ABSTRACT

The invention disclosed herein relates to a portable roof scaffold system comprising a combination transport/hook/standoff device, a fixed-direction ladder platform, a fixed-direction roof-ladder standoff, a multi-direction ladder platform, a multi-direction roof-ladder standoff, and one or more ladders. The combined use of these devices create an easily handled, easily set-up, scaffold which is supported above the roof surface, or the skeletal framework of a roof. The ladder platforms may be positioned at a predetermined angle with respect to the ladder to form a level working platform on any roof slope, and may be slid along the ladder to raise or lower the working level on the roof even while remaining parallel to the angles of hips and valleys in the roof frame. Self-locking features of the ladder platforms make them easy and safe to relocate as work progresses.

16 Claims, 9 Drawing Sheets

PORTABLE SUSPENDED ROOF SCAFFOLD SYSTEM

This is a continuation-in-part of Ser. No. 103,454, filed Aug. 6, 1993.

BACKGROUND OF THE INVENTION

The present invention relates generally to ladders and scaffolding and more particularly to ladder and scaffolding used on sloped roof structures.

In the prior art there are ridge attachment devices, ladder platform designs, and ladder standoffs. While these prior inventions are useful, they do not solve certain problems that continue to plague workers who must perform work on sloping roof surfaces and skeletal roof framework. The inventions cited, while improving the task of moving a scaffold up a roof slope, still require manual manipulations to lock such a device in place, thus placing the worker in an oftentimes awkward and unsafe position. The smaller devices, because they rest directly on the roof, risk damage to roofing materials which may easily occur in cases of extreme hot or cold weather, while the devices that are designed to be supported above the roof are too massive to be practical for the small jobs requiring such a device. In addition, the prior art addresses only the problem of perpendicular attachment of various ladders and platforms in relation to the roof ridge when erecting a scaffold on a roof surface. Not all roof surfaces are planar, but instead are a variety of intersecting planes creating valleys, hips, etc. which the prior art devices cannot reach effectively.

Clearly there is a need in the industry for a light weight, inexpensive, portable roof scaffold that can be quickly installed above a roof plane to protect existing roof surfaces, provide a means to install roof surfaces when only the skeletal frame is finished, and is capable of reaching into valleys.

The desire to meet these needs of the construction industry has been the stimulus for the disclosed invention.

SUMMARY OF THE INVENTION

The present invention relates to a portable roof scaffold system comprised of five components and one or more ladders of the type including a pair of longitudinally extending side rails interconnected by means of a plurality of laterally spaced rungs. These components and their related function and objectives are:

A. A combination transport/hook/standoff device attached to the ladder. This device is designed to serve three distinct functions. (1) It has wheels fixed to it which allow the ladder to be rolled into position on the roof. (2) Once the ladder is in the correct position on the roof, the device automatically rotates and with a pull of the ladder will lock on to the ridge of the roof, thus holding the ladder in position on the sloping roof surface. (3) The device is designed in such a way as to also serve as a ladder standoff, to support the ladder away from the roof surface approximately 5". It is the objective of the combination transport/hook/standoff device of this invention to allow the user to position a ladder on a sloped roof by simply pushing the ladder up the roof slope and letting the device lock itself and the ladder into position on the roof, at the same time supporting the ladder above the roof surface, with no further action required on the part of the user. It is a further objective of this device that by simply pushing the ladder forward and pulling a rope, the device may be reversed, thereby disengaging itself from the roof, thus allowing the ladder to be removed from the roof. An important benefit of this device is that at no time must the ladder be rotated into any position other than that originally intended for use on the roof. Another unique feature of this device is its ability to perform the same functions as described above on a skeletal framework of a roof consisting of only rafters and a ridge board. In that situation, the device does not travel to the ridge of the roof on the wheels, but is supported by a metal rod which slides on the top edge of the rafters.

B. A fixed-direction roof-ladder standoff. This device is designed to serve three distinct functions. (1) To provide the means for supporting the lower end of a ladder above the sloped surface of a roof, when the ladder is lying perpendicular to the roof ridge and is supported at the ridge by the transport/hook/standoff device described above, thus allowing free movement of a ladder platform above the surface of the roof. (2) To provide the means for supporting the lower end of a ladder above the sloped skeletal framework of a roof, when the ladder is lying perpendicular to the ridge of the roof and is supported at the ridge by the transport/hook/standoff device, thus allowing free movement of a ladder platform above the framework and (3) to provide a simple, yet effective means for intermediate support for the ladder should it be necessary on roof surfaces or frameworks of low slope.

C. A fixed-direction ladder platform. This device is designed to serve one distinct function. (1) To provide an adjustable support that will ride on a sloping ladder when the ladder is supported at both ends and lying perpendicular to the roof ridge, thus making possible a moveable, level work surface supported above the roof surface or roof framework. This support may be used as an independent working platform, or if used in tandem with another ladder platform, may serve as a scaffold support. It is the objective of the fixed-direction ladder platform to enable a worker to move a working platform up a sloping roof surface and be able to release it and have it automatically lock itself into its new position on the ladder with no further manipulations required of the worker, thus greatly improving both worker productivity and safety. It is also an objective of the fixed-direction ladder platform to allow this process to be reversed with the flip of a lever, thus releasing the self-locking feature of the platform and allowing it to be lowered back down to the roof eave, either by rope or the manual support of the worker.

D. A multi-directional roof-ladder standoff. This device is designed to serve four distinct functions. (1) To provide the means for removably and pivotally attaching both the lower and upper ends of a ladder to a sloped roof surface, (2) to provide the means for removably and pivotally attaching both the lower and upper ends of a ladder to the skeletal framework of a roof, (3) to provide the means for supporting both the lower and upper ends of a ladder above a sloped roof plane, whether it be a roof surface or a skeletal framework, and (4) to provide the means for intermediate support for the ladder should it be necessary on roof surfaces or frameworks of low slope. It is the objective of this device to make it possible to attach a ladder to a sloped roof plane in such a way that the ladder is supported above the roof plane, and can be rotated to any desired angle (lockable at 11¼ degree increments). This type of attachment allows the ladder to serve as the support mechanism for the multi-directional ladder-platform.

E. A multi-directional ladder platform. This device is designed to serve one distinct function. (1) To provide an adjustable support that will ride on a sloping ladder when the ladder is suspended above the surface or skeletal framework of a roof, and is able to be set in a position level with the earth regardless of the slope of the roof or the skew of the ladder in relation to the slope of the roof plane. The multi-directional ladder platform also contains the self-locking and reversible features of the fixed-directional ladder platform described above, making it safe and easy to relocate the platform to a new position as the work progresses. It is the objective of this device to provide the means for maintaining a level platform support as the device is moved up and down the slope of a roof while remaining parallel to the valleys and hips of the roof frame. This compound adjustment, unknown to ladder platforms of the prior art, makes it possible for a worker repairing a steep roof valley to support a ladder parallel to the valley using two of the multi-directional roof-ladder standoffs, and by attaching two multi-directional ladder platforms to it provide both a standing area, and a "workbench", that can be moved up and down the roof slope.

As shown above, various combinations of the aforementioned components when used with one or more ladders of sufficient strength to carry the loads of workers and materials, provide the worker with the means to overcome problems that have always plagued roof work and made it a risky proposition to perform even minor repairs. Workers can now set up a roof scaffold with little time and effort being spent on job preparation. Work on structures may be performed with little or no damage to existing roof surfaces. Workers building new homes can install roof sheathing, felt paper, and shingles with a greater level of safety and efficiency than ever before because they can now work above the skeletal framework instead of on it or under it. In addition, workers can now scaffold over areas that could not be easily reached by devices of the prior art such as large valleys created by intersecting roof sections.

While the present invention has been particularly shown and described in reference to preferred embodiments thereof, it will be understood by those skilled in the art that changes in the form and details may be made therein without departing from the spirit and scope of the invention. As such it is intended that the present invention only be limited by the terms of the appended claims.

BRIEF DESCRIPTION OF THE DRAWINGS

Corresponding reference characters indicate corresponding parts throughout the several views of the drawings.

DETAILED DESCRIPTION OF THE INVENTION

Figure 1:
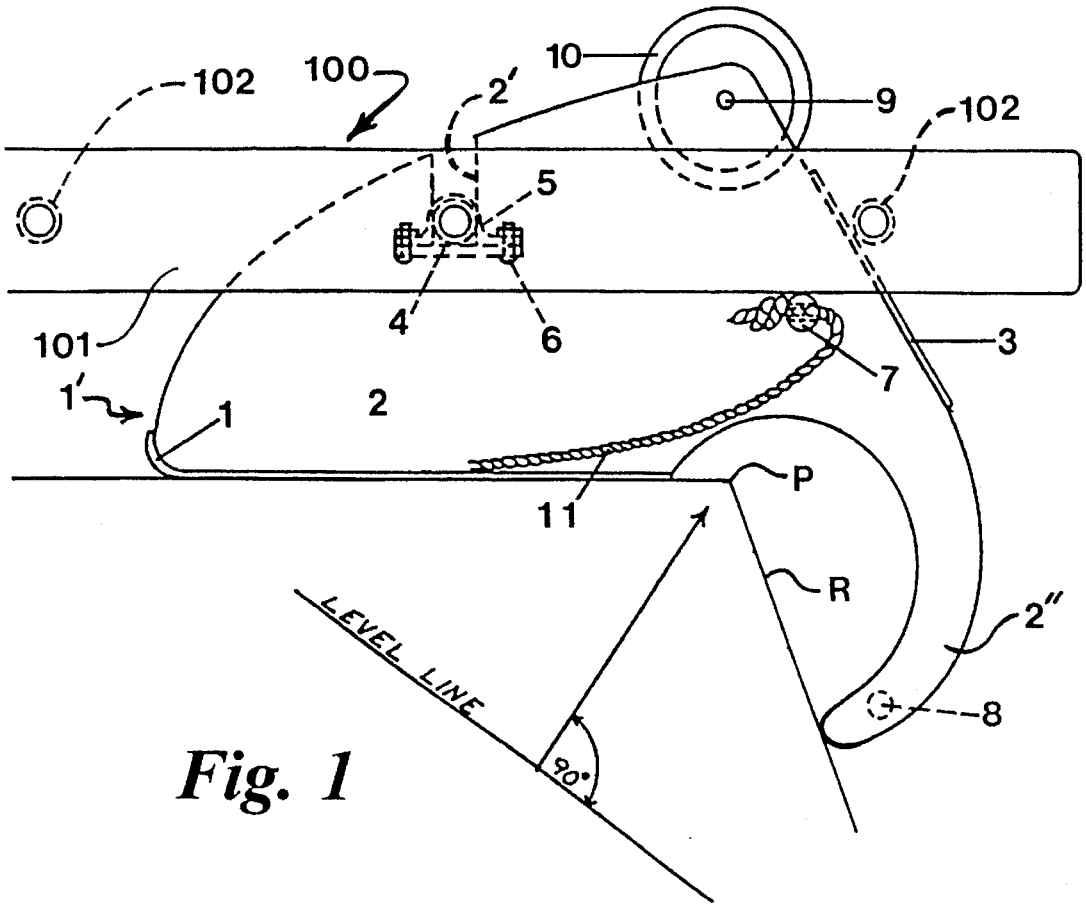
FIG. 1 is a side view of the combination transport/hook/standoff device as it would look attached to a ladder and hooked to a roof ridge.
Figure 2:
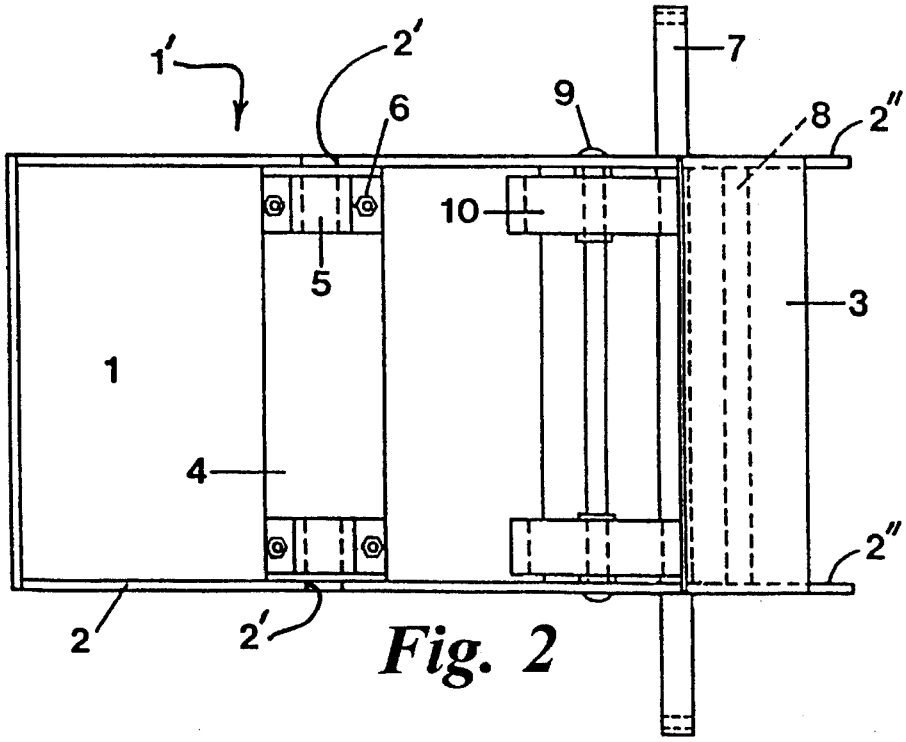
FIG. 2 is a top plan view of the combination transport/hook/standoff device of FIG. 1 with the ladder and roof removed.

Referring now to the drawings and in particular to FIGS. 1–6, there is shown a combination transport/hook/standoff device indicated generally at 1', attached to a ladder 100 including two side rails 101 (only one is shown) and rungs 102 extending transversely between the side rails and connecting the side rails at longitudinally spaced locations. The transport/hook/standoff device 1' is broadly referred to as a "standoff" or a "hook device" in the claims. The device is mounted to a rung 102 of the ladder 100 by a flat support bar 4, half-round clamps 5, and standard nuts and bolts 6. In the position shown in FIG. 1 on the roof R, sides 2 of the device, made of metal plate stock approximately 3/16" in thickness, are supported on a metal plate 1, which allows the device to slide into position without damaging the roofing material. The metal plate 1, also ties the sides 2 together as does another metal plate 3 and provides bracing. Slots 2' receive one of the rungs 102 for bringing the rung into engagement with the flat support bar 4. The half round clamps 5 are placed over the rung 102 at opposite ends of the flat support bar 4 and secured to the flat support bar with nuts and bolts 6 to capture the rung. In a preferred embodiment, the slots 2', flat support bar 4, half round clamps 5 and nuts and bolts 6 constitute ladder mount portion of the device 1'; and the sides 2 and metal plate 1 constitute support means. At the curved end of the device (designated by reference numeral 2", and broadly referred to as a securement portion of the device 1') is yet another means of cross bracing in the form of a metal rod 8, which ties the two hook ends together, and is also designed to serve as an attachment point for an auxiliary safety line (not shown) should the device be used in a situation where such additional safety measures would be deemed prudent. A steel axle 9, mounted at the top of the device 1' supports two wheels 10, which allow the device, in a first position, to transport the ladder 100 to the ridge P of the roof R before it rotates into a second position to act as a hook and standoff (see FIGS. 3 and 4). Once in the second position, as shown in FIG. 1, the support bar 7 engages the rails 101 of the ladder 100 and carries a portion of the weight of the ladder that is being thrust against the roof surface, thus helping to lock the device onto the roof ridge P while at the same time supporting the ladder above the surface of the roof R. The support bar 7, has a hole drilled in each end to allow the insertion of a rope 11, which is used to reverse the device and thus allow the ladder to be rolled back down the roof. The rope 11 constitutes an actuator, in the preferred embodiment, which permits the device 1' to be pivoted from the second position (FIG. 4) back to the first position (FIG. 3) for transporting the ladder 100 down the roof R. Before the rope 11 may be used, the ladder and device must be moved away from the roof at the ridge P.

Figure 3:
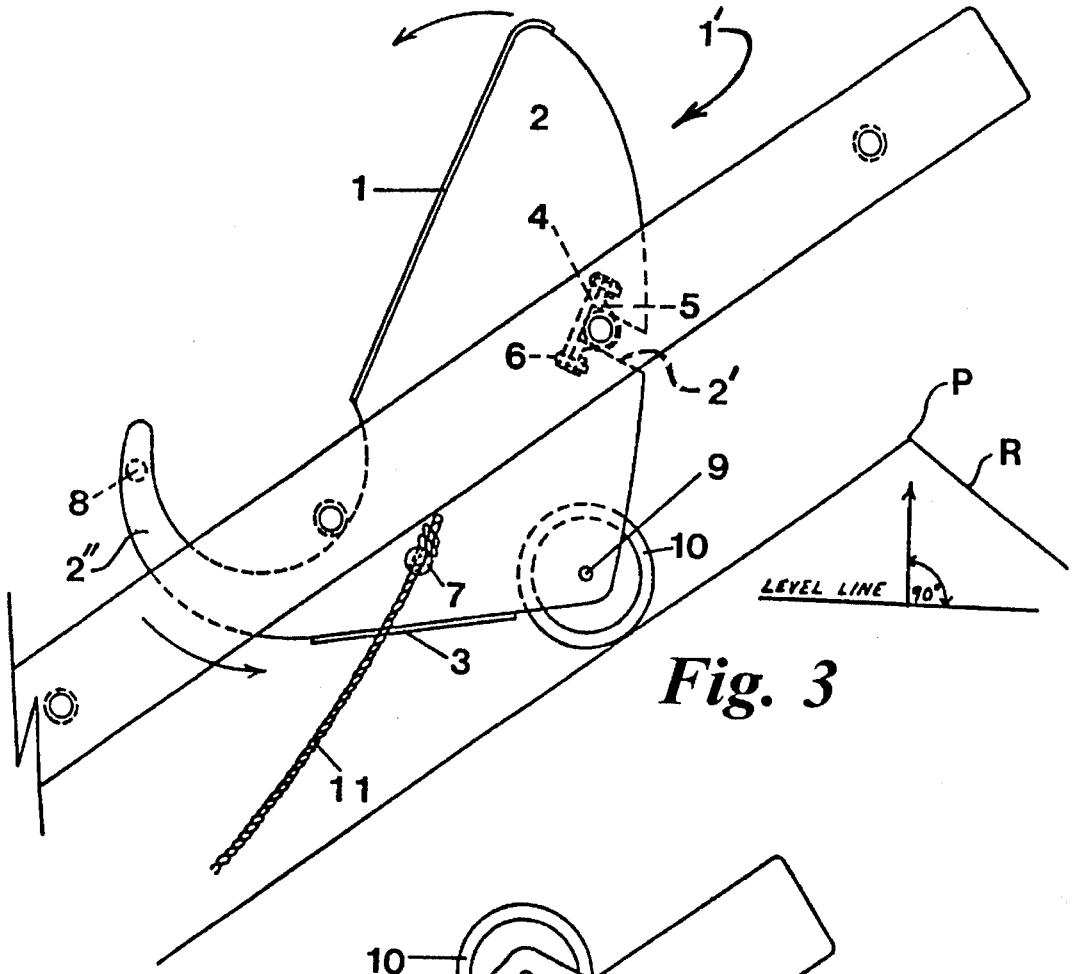
FIG. 3 illustrates the combination transport/hook/standoff device as it transports a ladder to or from the ridge.

FIG. 3 is an illustration of the combination transport/hook/standoff device 1' as it travels up the roof slope toward the ridge. Once past the ridge of the roof, due to the location of the pivot point eccentrically of the center of mass of the device and more toward the top end of the ladder 100, gravity will cause the device 1' to rotate in the direction of the curved arrows toward the second position of the device in which it is in position for hooking the ridge P of the roof R to secure the ladder 100 from sliding down the roof. Once it rotates, a pull of the ladder in a direction down the slope of the roof will cause the plate 1, to come into contact with the surface of the roof, the plate will then slide across the ridge P of the roof causing the device to seat itself and attach to the ridge of the roof.

Figure 4:
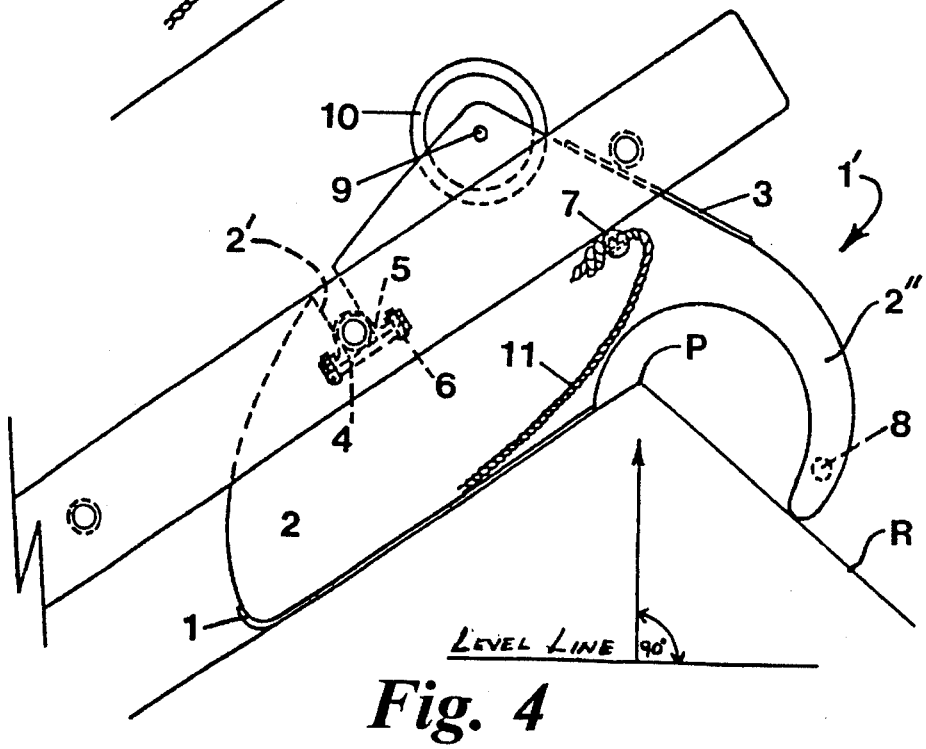
FIG. 4 illustrates the combination transport/hook/standoff device after automatically rotating and seating itself on the surface of the roof.

FIG. 4 shows the combination transport/hook/standoff device 1' in position at the ridge P of the roof supporting the ladder away from the roof surface while simultaneously locking the ladder to the ridge.

Figure 5:
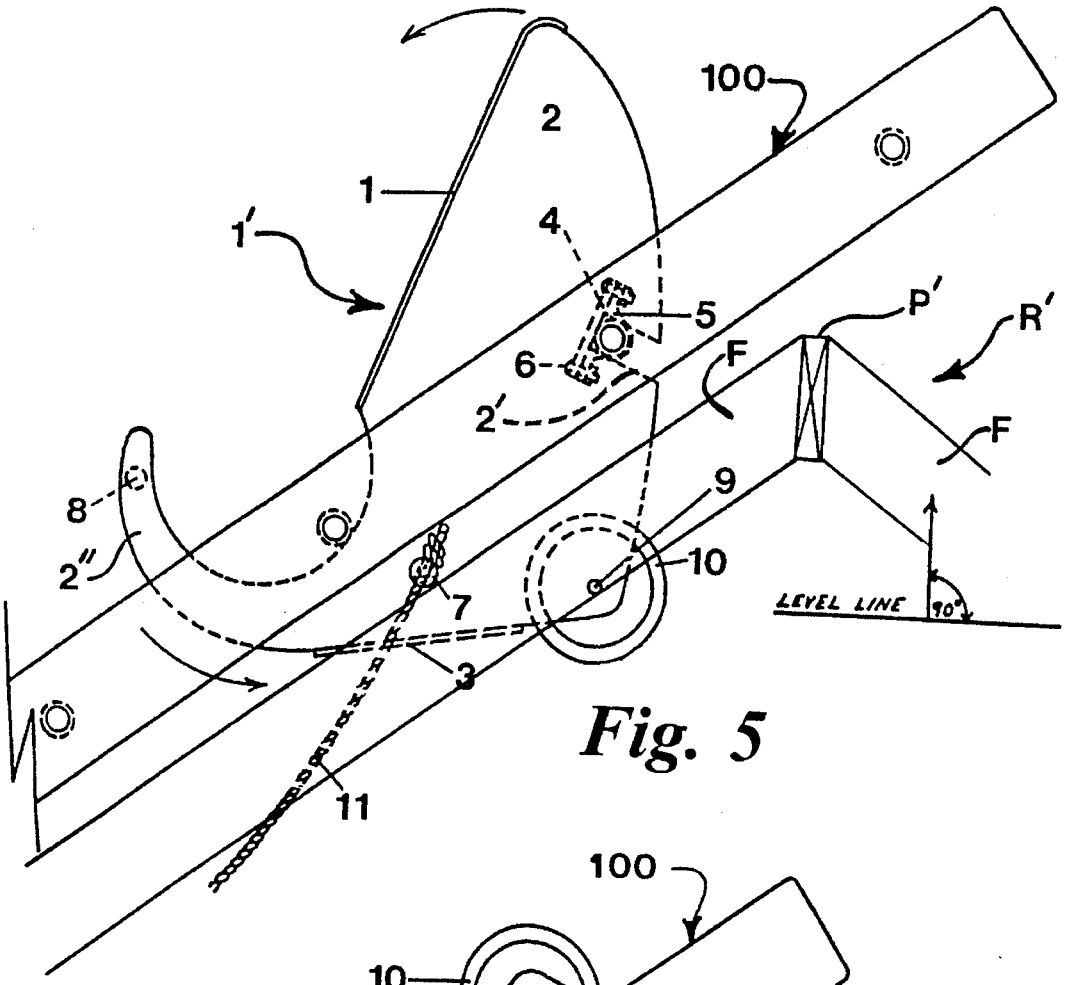
FIG. 5 illustrates the combination transport/hook/standoff device as it transports a ladder to or from the ridge of a skeletal roof frame.

FIG. 5 illustrates the ladder 100 being transported to the ridge R' of a roof frame where no sheathing is present for the wheels 10 of the combination transport/hook/standoff device 1' to roll on. In this situation, the support bar 7 spans between adjacent rafters F of the roof R with opposite ends of the support bar overlying and engaging respective rafters to support the ladder 100 above the roof R'. The sheathed roof R and the skeletal frame roof R' may be broadly referred to as sloped roof structures. The support bar 7 is used for sliding the device 1' along the top edge of the rafters F of the roof frame until contact is made with the ridge board P', whereupon the wheels 10 will roll up and over the ridge board allowing the device to clear the roof frame so that it can rotate into position to serve as a hook and standoff. Extension pipes (not shown) may be used to add length to the support bar 7 when the rafter spacing of the roof frame warrants their use. When extension pipes are used they are attached to the support bar 7 by insertion of the support bar 7 into the pipes until the pipes contact the sides 2 of the device 1', a bolt is then placed through holes in the extension pipes matched with the holes in the support bar 7 that is normally used for attachment of the reversal rope 11.

Figure 6:
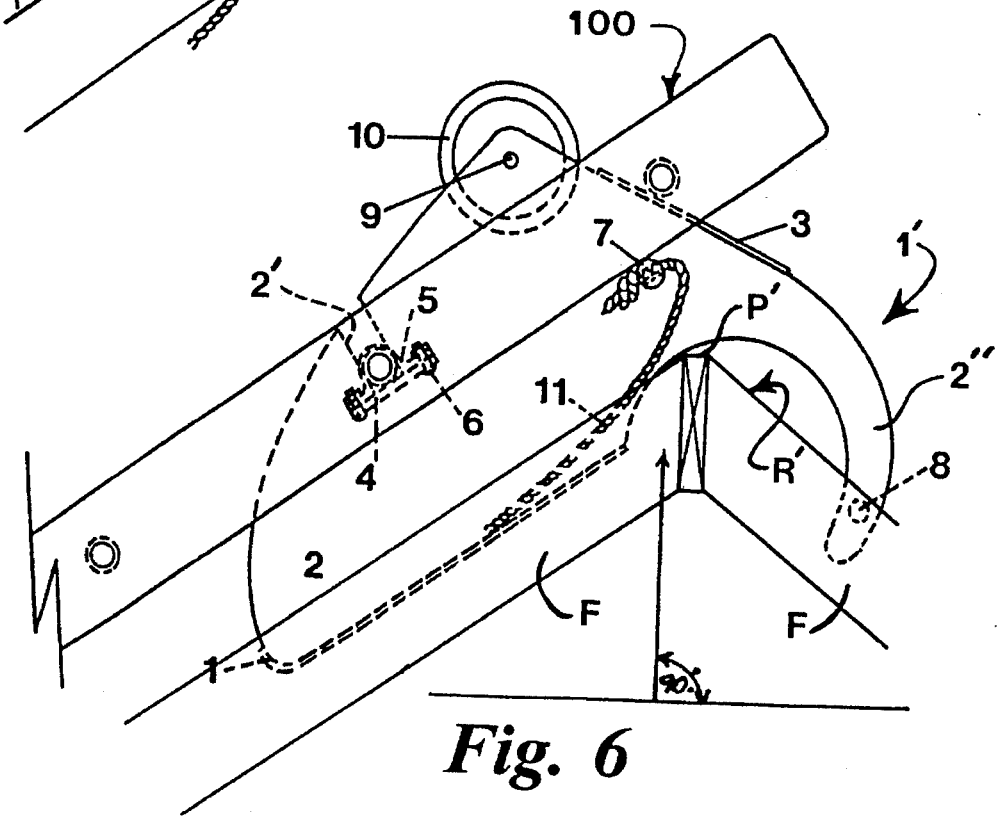
FIG. 6 illustrates the combination transport/hook/standoff device after automatically rotating and hooking itself on to the ridge board of a skeletal roof frame.

FIG. 6 illustrates the combination transport/hook/standoff device 1' after it has rotated and the ladder has been pulled down the slope of the roof R' causing the curved end portion 2" of the device to lock on to the ridge board P' of the roof frame. In this situation the plate 1 of the device has nothing to rest on but is held in position instead by the lever action that the ladder 100 exerts when raised at the lower end and contact is made with the support bar 7.

Figure 7:
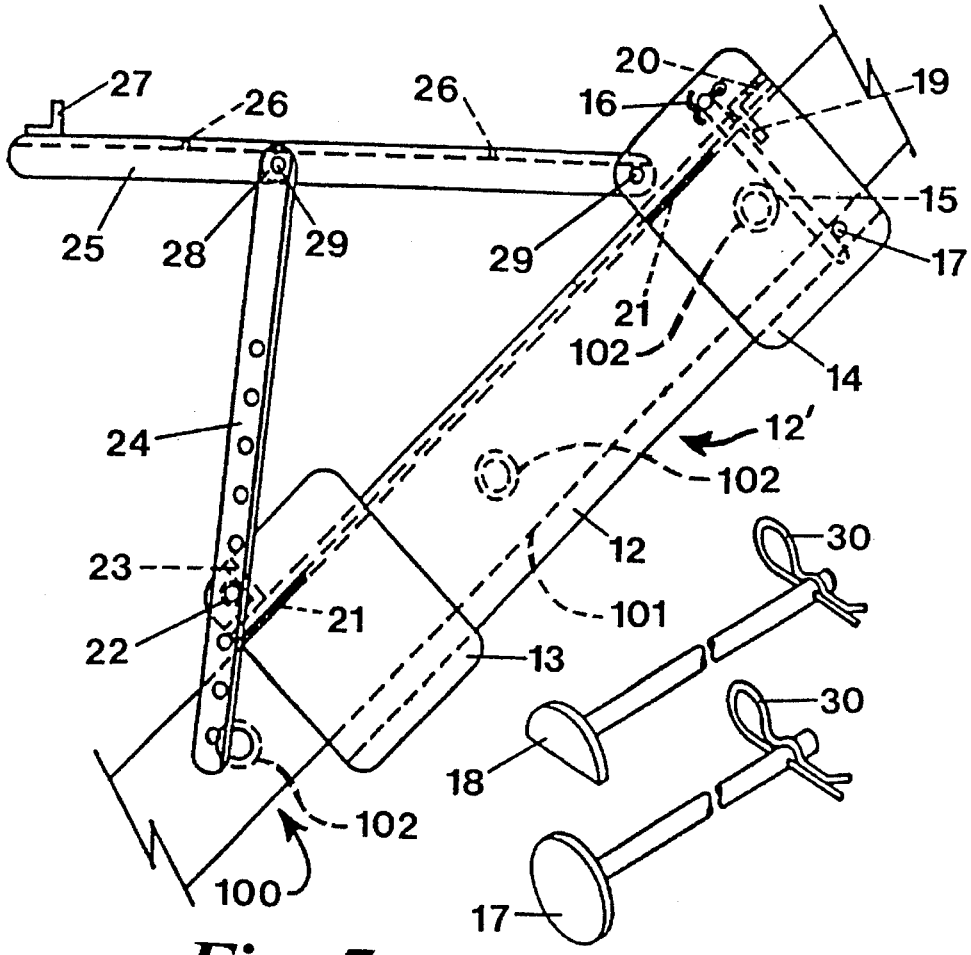
FIG. 7 is a side view of a fixed-direction ladder platform attached to a sloping ladder.
Figure 8:
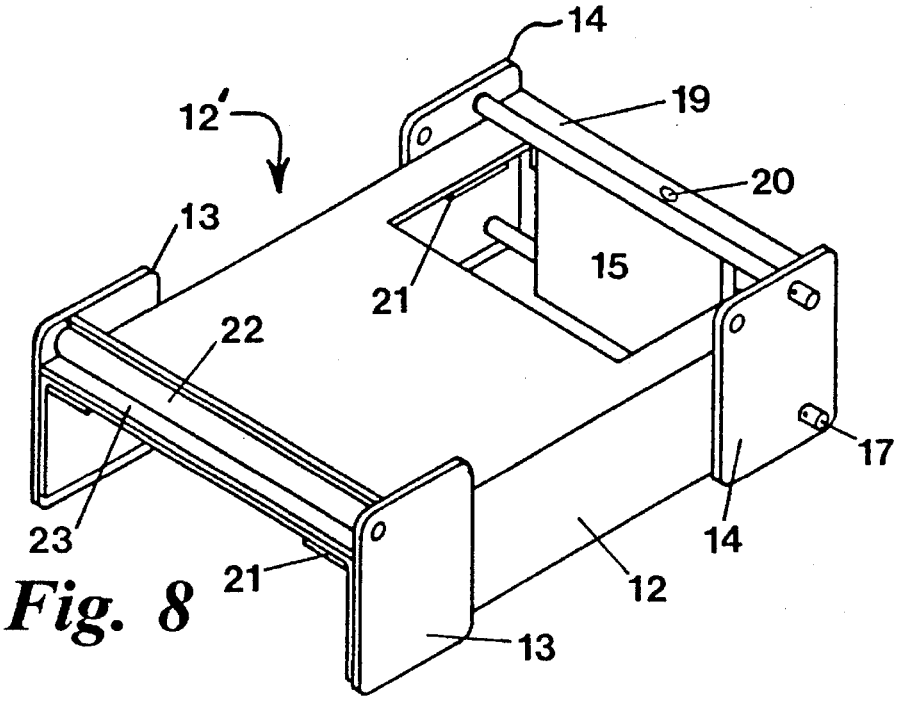
FIG. 8 is an isometric view of the base of the fixed-direction ladder platform. The platform support arms have been left off for the sake of clarity.

A fixed-direction ladder platform (generally indicated at 12') is shown in FIG. 7 locked into position against one of the rungs 102 of the ladder 100. The platform 12' includes a metal, channel shaped section 12, to which the other components of the device are connected. Rectangular metal plates 13 mounted on opposite sides of one end of the channel section 12 support the ends of a lock bar guide 22 (FIG. 8). The rectangular plate 13 seen in FIG. 7 creates a space to allow for a bushing 28, in the joint between support arms 24, and 25 (broadly, "first and second supports"). Only one of each of this part of support arms 24 and pair of support arms 25 is shown in the drawings. Another pair of rectangular plates 14 are mounted on opposite sides of the channel section 12 and an end opposite the rectangular plates 13. The rectangular plates 14 pivotally mount a lever pin 15', to which a lock lever 15 is attached. The ends of the lever pin 15' are secured in openings in the plate 14 by cotter pins 16.

The platform 12' is installed, on the ladder 100 by placing the channel section 12 over the rails 101 with portions of the rails being received in the channel section. A lock bar 17 is inserted through laterally aligned openings in the rectangular plates 14 on the underside of the rails 101. A ring pin 30 is placed on the end of the lock bar 17 to secure it on the platform 12', thereby securing the platform 12' on the ladder. The platform 12' has four nylon glide blocks 21 which engage the tops of the rails 101 to facilitate sliding the platform longitudinally of the ladder 100. To position the platform 12' at a location higher on the ladder 100, a worker may slide the platform upwardly. The lock lever 15 engages the rungs 102 as the platform 12' is moved upwardly and pivots (in a clockwise direction as seen in FIG. 7) out of the way of the rungs, permitting the platform to pass by the rungs. When the platform 12' reaches the desired location, it is moved upward so that the lock lever 15 passes over the rung 102 nearest the desired platform location. The platform 12' is then permitted to slide back down the ladder 100. The lock lever 15 tries to pivot in a counterclockwise direction (as viewed in FIG. 7) when it engages the rung 102, but is held from swinging out of the way of the rung by the lock bar 17 (broadly, "stop"). Thus, the lock lever 15 and lock bar 17 cooperate to prevent further downward motion of the platform 12' to hold it in the selected position.

To move the platform 12' to a lower position on the ladder 100, the platform is moved upwardly along the ladder until the lock lever 15 is clear of the rung 102. The worker reaches through a hole in the upper surface of the channel section 12 and swings the lock lever 15 up through the hole, past the twelve o'clock position and into engagement with the metal angle 19. In this position, the lock lever 15 does not engage the rungs 102, permitting the platform 12' to slide freely down the ladder 100. Just before the desired location of the platform 12' is reached, where the lock lever 15 is still clear of any rung 102, the lock lever is swung back down into the path of the rungs to engage the next lower rung and hold the platform in place. The metal angle 19 provides additional strength to the channel section 12, and has a hole 20 in which a rope (not shown) may be secured for use in moving the platform along the ladder 100.

The lock bar guide 22, welded to a support angle 23, aids in the installation of the lock bar 18, as it passes through support arms 24, to lock them in position for the desired angle of the roof. The holes 26, drilled in the support arm 25, are for anchoring walk-boards or a small platform to the framework of the device. The metal angle 27, is to aid in keeping walk-boards from sliding off the end of the support arm 25, should the user decide not to make use of the holes 26. The permanent joints holding the support arms 24 and 25 to each other, and support arm 25 to the rectangular metal plate 14 are accomplished with the use of rivets 29. The support arms 24 and 25 can be adjusted for any roof slope up to a 16" rise per 12" of run without crossing the plane represented by the lowermost portions of the ladder platform device, thereby never threatening to damage the roofing material.

Figure 9:
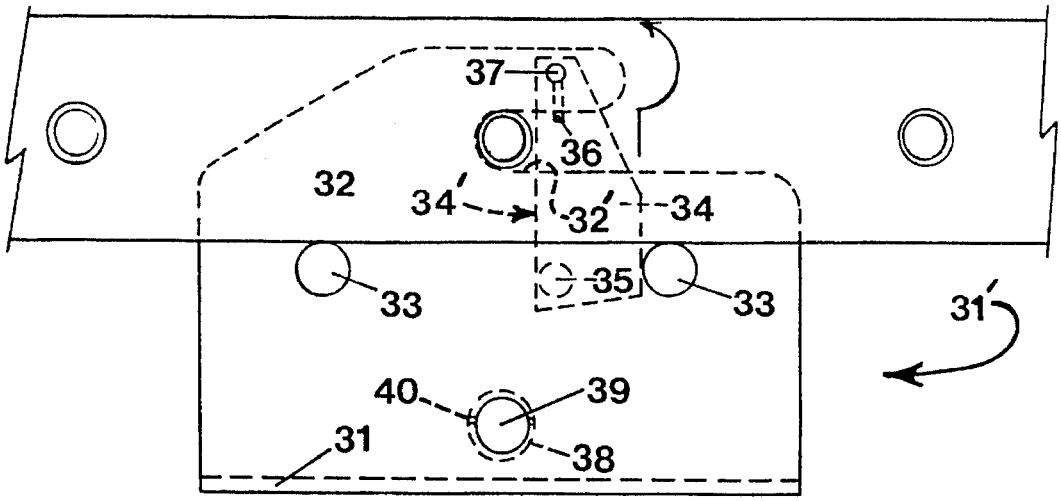
FIG. 9 is a side view of a fixed-direction roof-ladder standoff attached to a ladder.
Figure 10:
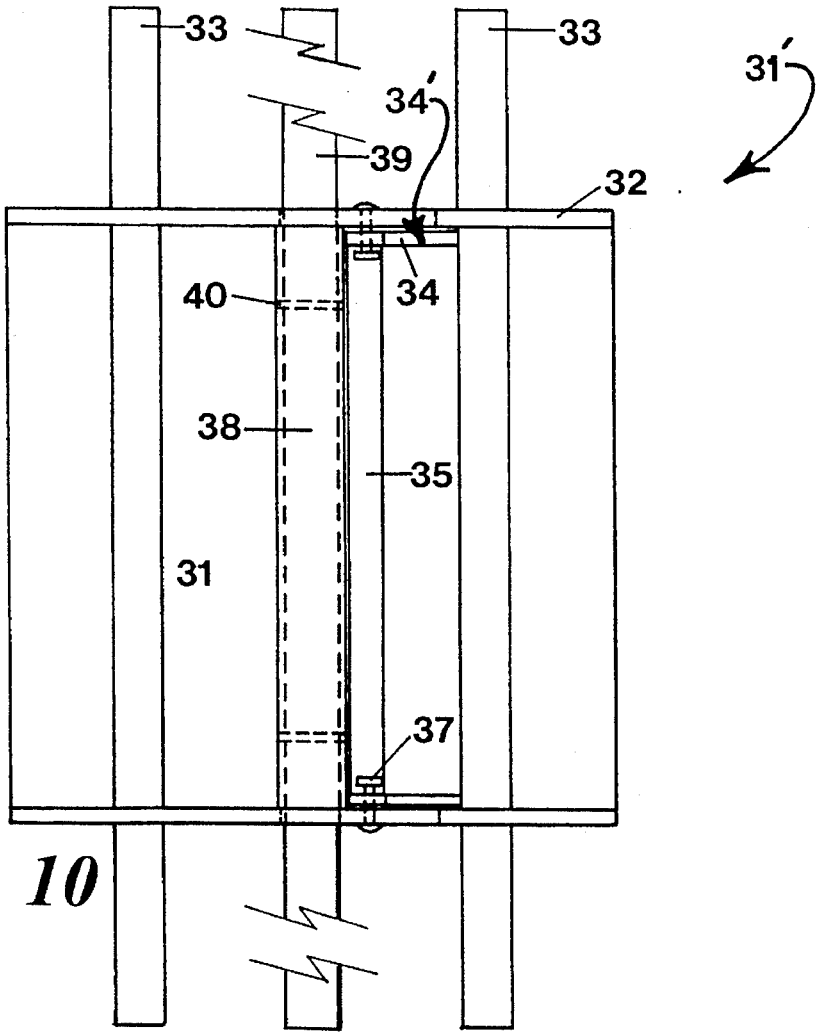
FIG. 10 is a top plan view of the fixed-direction roof-ladder standoff of FIG. 9 with the ladder removed.

A fixed direction roof ladder standoff, indicated generally at 31', is shown in FIGS. 9 and 10 to comprise a base plate 31 and two sides 32 which together form support means in the preferred embodiment. The base plate 31 and sides 32 are made from sheet metal approximately ⅛"–3/16" in thickness and are rigidly joined together in a suitable manner. Elongated metal rods 33 approximately 1" in diameter, passed through holes drilled at strategic locations in the sides 32, distribute the weight placed on the ladder 100 to the rails 101 of the ladder taking the strain off of the rung 102. The rods 33 also hold the standoff 31' (broadly, "second standoff") on the ladder and prevent pivoting of the standoff, should the ladder be raised from the roof R for any reason such as relocation of the ladder. A more positive lock of the standoff 31' to the ladder is achieved by a rung-receiving slot 32' and a rotatable locking lever 34' made of two metal wedges 34, connected by an elongated rod 35. The slot 32' and locking lever 34' constitute the ladder mount portion of the standoff 31'. The locking lever 34' contains slots 36, that allow vertical movement prior to rotation on fixed pins 37. Once the ladder rung 102 is in proper position the locking lever 34' is easily rotated and slid down to wedge against one of the metal rods 33, thus locking the device to the ladder. An elongated metal tube 38, located in the center and toward the bottom of the standoff 31' serves as means for attaching an elongated metal rod 39, when the standoff is to be used to support the ladder above the framework of a sloped roof plane. The metal rod 39, is passed through the metal tube 38, and holes in the rod are matched to holes in the tube 40, to allow insertion of removable ring pins (not shown) to lock the rod in place. Once attached to the fixed-direction roof ladder standoff 31', the elongated metal rod 39 will support the standoff and thus the attached ladder by resting on the top edge of the rafters F that make up the framework of the sloped roof plane. Thus, both the base plate 31 and metal rod 39 constitute support means in the preferred embodiment.

Figure 11:
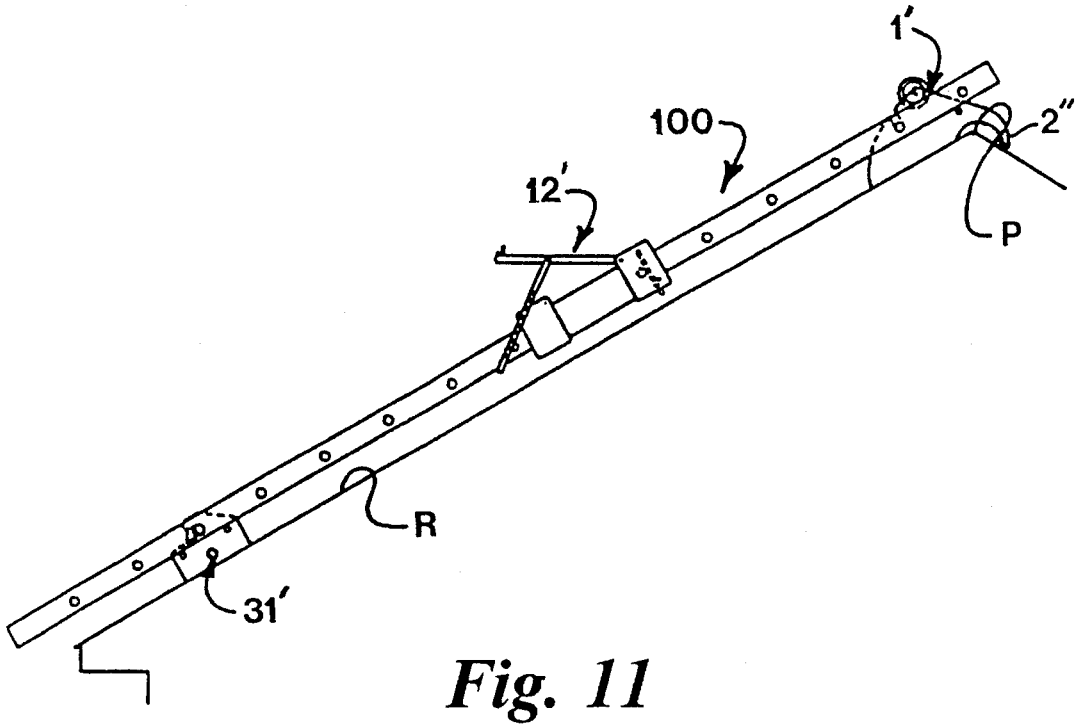
FIG. 11 illustrates the combination transport/hook/standoff device, the fixed-direction ladder platform, the fixed-direction roof-ladder standoff, and a ladder in use together on a sloped roof surface.
Figure 12:
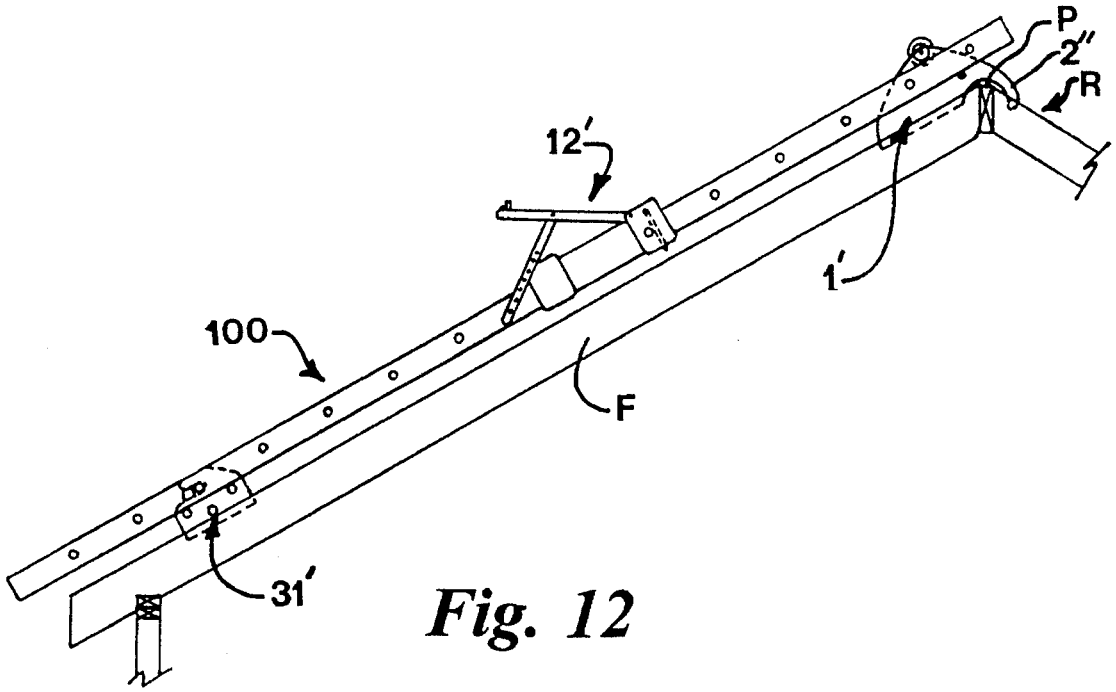
FIG. 12 illustrates the combination transport/hook/standoff device, the fixed-direction ladder platform, the fixed-direction roof-ladder standoff, and a ladder in use together on a sloped skeletal roof frame.
Figure 13:
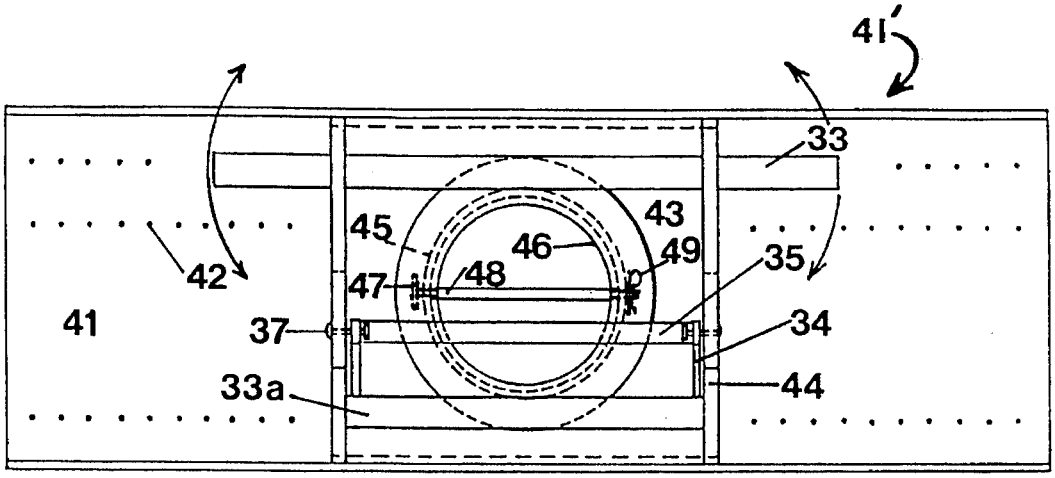
FIG. 13 is a top plan view of a multi-directional roof-ladder standoff device.
Figure 14:
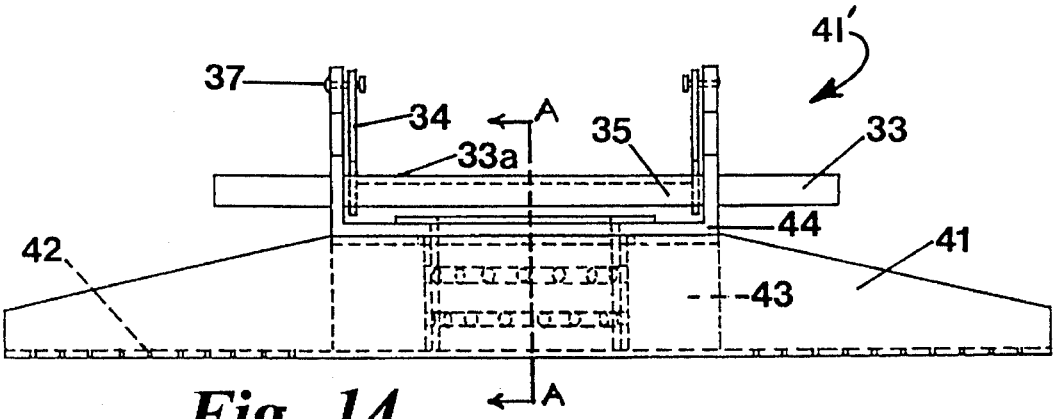
FIG. 14 is a front view of the multi-directional roof-ladder standoff device.
Figure 15:
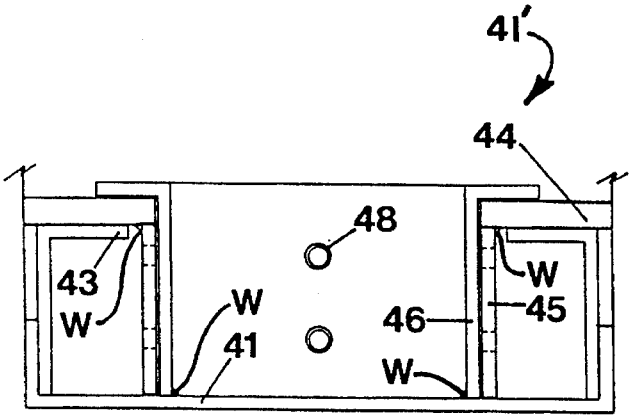
FIG. 15 is an enlarged, fragmentary view of the pivotal connection attaching a turret of the multi-directional roof-ladder standoff to its base, as indicated by the section line A—A in FIG. 14.
Figure 16:
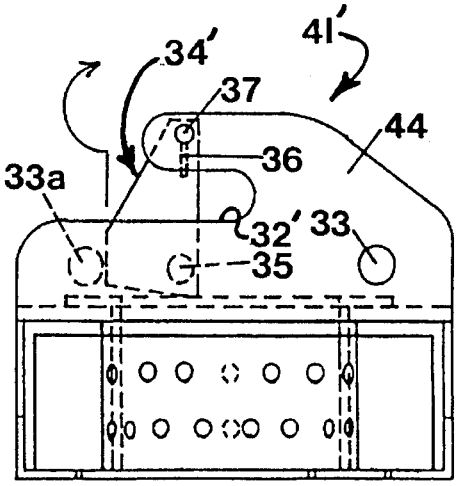
FIG. 16 is an end view of the multi-directional roof-ladder standoff.

FIG. 11 illustrates how the combination transport/hook/standoff device 1', the fixed-direction ladder platform 12', and the fixed-direction roof ladder standoff 31' would appear in actual use on a sloped roof surface. FIG. 12 illustrates how the combination transport/hook/standoff device 1', the fixed-direction ladder platform 12', and the fixed direction roof ladder standoff 31' would appear in actual use on the skeletal framework of a sloped roof.

A multi-direction roof ladder standoff, generally indicated at 41', is shown in FIGS. 13–16 to comprise an elongated channel shaped base 41, that is removably attachable to a roof surface or skeletal roof framework by means of driving doublehead nails through the many strategically placed holes 42, that allow for reaching across standard framework member spacings. The standoff 41' is another embodiment of the first standoff in which the support means constitutes the base 41 and the securement portion constitutes the holes 42 in the base. The ladder mount portion of the standoff 41', which will now be described, permits pivoting between the base 41 and the ladder 100 to allow the ladder to be arranged in a skewed position relative to the slope of the roof. In the center of and welded to the channel shaped base 41, is a rectangular channel shaped base 43, which supports a turret 44. The turret 44, is essentially the same device as the fixed-direction roof ladder standoff 31' illustrated in FIGS. 9 and 10, except that one of the support rods 33*a*, has been modified so as to serve only as part of the locking mechanism and not as a support for the ladder rails. This modification allows the ladder to pivot about an axis perpendicular to the plane of the roof R while being set in position on the roof surface or framework and thus will not pull the attaching nails loose through lever action. The turret 44 permits the ladder 100 to be pivotally attached to the elongated channel shaped base 41. This pivotal attachment is achieved through welding a metal sleeve 45, to the bottom of the turret 44 so that it passes through a circular cutout in the base 43 and reaches almost to the channel shaped base 41. The metal sleeve 45 fits around and is held in place by a metal tube 46, which is attached by welds W (FIG. 15) to the channel shaped base 41. The metal tube 46 has a flange at the top which serves to lock the base of the turret 44 to the elongated channel shaped base 41, while allowing the turret to rotate on channel shaped base 43. The turret 44 can be rotated to any position within the 360 degrees of a circle, however, means for locking the turret in position are provided in increments of 11¼ degrees. The means for locking the turret in a desired position is provided by two rows of holes drilled through the sleeve 45. The holes in each row are spaced 22½ degrees apart, and by offsetting the second row with the first, a hole is provided every 11¼ degrees. These rows of holes are matched with two holes drilled through the flanged tube 46, when a hole in the sleeve 45 lines up with a hole in the flanged tube 46, then a locking bar 47, is slid through the holes, through a guide tube 48 and then secured with the attachment of a ring pin 49, thus locking the turret 44, and ladder 100 at the desired angle to the channel shaped base 41. The multi-directional roof standoff 41' may be used in place of both the device 1' and fixed direction standoff 31'.

Figure 17:
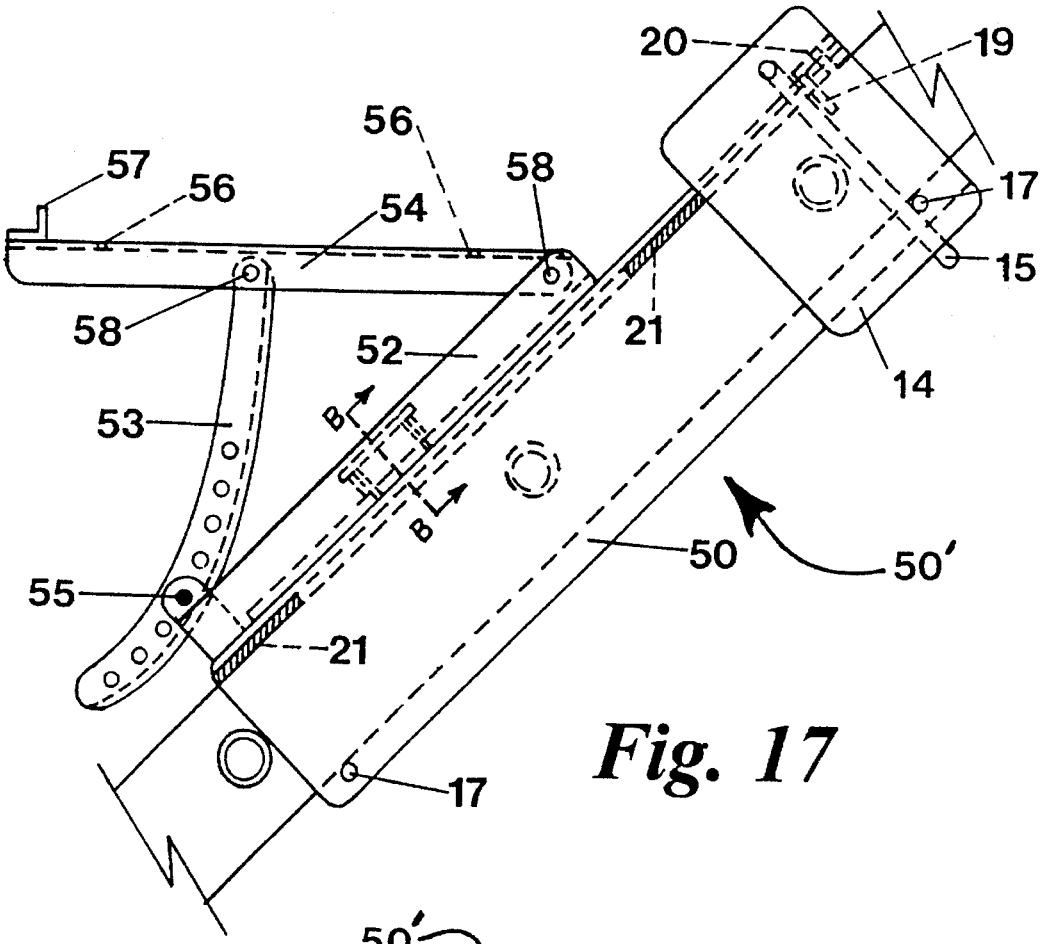
FIG. 17 is a side view of a multi-directional ladder platform attached to a sloping ladder.
Figure 18:
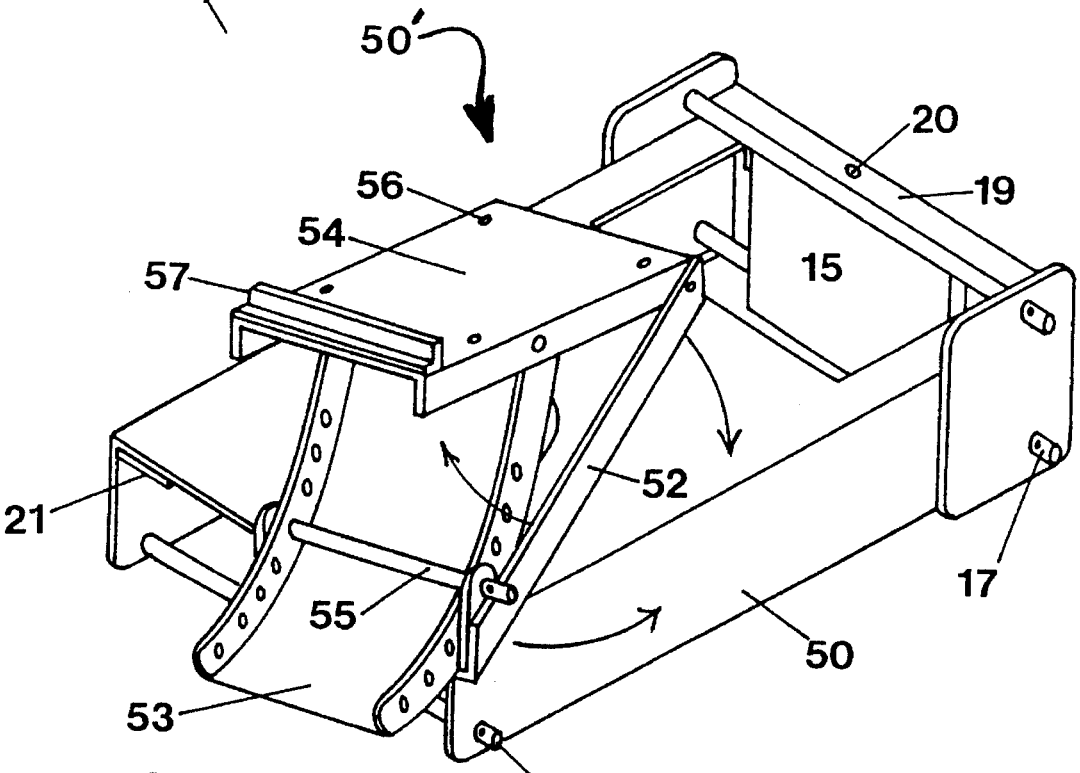
FIG. 18 is an isometric view of the multi-directional ladder platform, illustrating the vertical and horizontal adjustment of the support arms.
Figure 19:
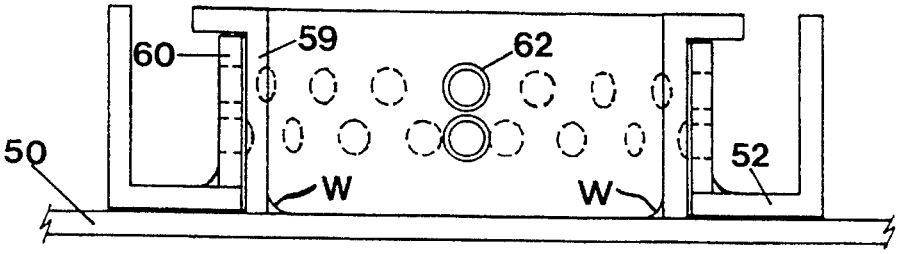
FIG. 19 is an enlarged, fragmentary view of the pivotal connection attaching a support arm base to a larger platform base of the platform, as indicated by the section line B—B in FIG. 17.

A multi-directional ladder platform 50', shown in FIGS. 17–19, is similar in design and function to the fixed-direction ladder platform 12' illustrated in FIGS. 7 and 8 and thus uses some of the same components. The platform 50' comprises a metal, channel shaped section 50, to which the other components of the platform are connected. The rectangular metal plate 14 supports the ends of the lock lever 15, and the lock bar 17, through the use of holes drilled in strategic points to accommodate these components. The lock lever 15 is held in position by cotter pins (not shown), while the lock bar 17, is held in place by a removable ring pin (not shown). The platform 50' may be positioned along the length of the ladder 100 and secured in place by operation of the lock lever 15 and lock bar 17 in the same way described above for the platform 12'.

Because the platform 50' is mounted to a ladder that may be skewed in position on the roof another lock bar 17, is required at the rear of the platform. This lock bar 17 is also held in place by a removable ring pin (not shown). Unlike the fixed direction platform 12', the multi-direction platform has a support arm base 52 pivotally attaching a lower support arm 53, and an upper support arm 54, to the channel section 50. The lower support arm 53 is curved and contains strategically located holes allowing the upper support arm 54, to be set level with the earth when the ladder to which the platform is attached is parallel to the direction of the rafters that form the structure of a roof plane. A lock bar 55 placed through the holes in the support arm base 52, and the support arm 53, lock the arm at the desired angle and a ring pin (not shown) is attached to secure the lock bar. Support arm 54 has four holes 56, to provide attachment of a larger platform or a walkboard to the support arm, as well as a metal angle 57, to keep a walkboard from sliding off should the holes 56, not be used. Combining the vertical adjustment of the support arms with the horizontal adjustment made possible by the pivotal connection of the support arm base 52 to the channel section 50, makes it possible to set the support arm 54, in a position level with the earth regardless of the angle of the ladder 100 to which it is attached. The permanent joints holding the support arms 53 and 54 to each other, and support arm 54 to the base 52 are accomplished with the use of rivets 58. FIG. 18 illustrates the vertical and horizontal adjustment of the support arms 53, 54 on which a worker is supported, in relation to the channel section 50, of the multi-directional ladder platform.

The pivotal connection between the support arm base 52, and the channel section 50, of the multi-directional ladder platform 50' is made by passing a flanged metal tube 59, through a metal sleeve 60, which is attached by welds W to the base 52, and through a circular cut-out in the base 52, and then welding the flanged tube to channel section 50, thus permanently locking the base 52, to the channel section 50. The means for locking the base 52, at a desired angle to channel section 50 is provided through two rows of holes drilled through the sleeve 60, the holes in each row are spaced 22½ degrees apart, by off setting the second row with the first, a hole is provided every 11¼ degrees. These rows of holes are matched with two holes drilled through the flanged tube 59, when a hole in the sleeve 60, lines up with a hole in the flanged tube 59, a locking bar 61, is slid through the holes and through a guide tube 62, and then secured with the attachment of a ring pin 63, thus locking the base 52, at the desired angle to the channel section 50.

Figure 20:
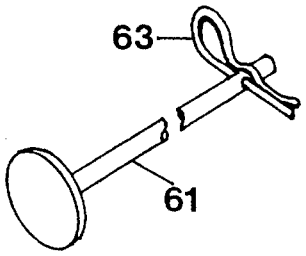
FIG. 20 is an illustration of how all five component parts of the portable roof scaffold system may be used together.
Figure 20:
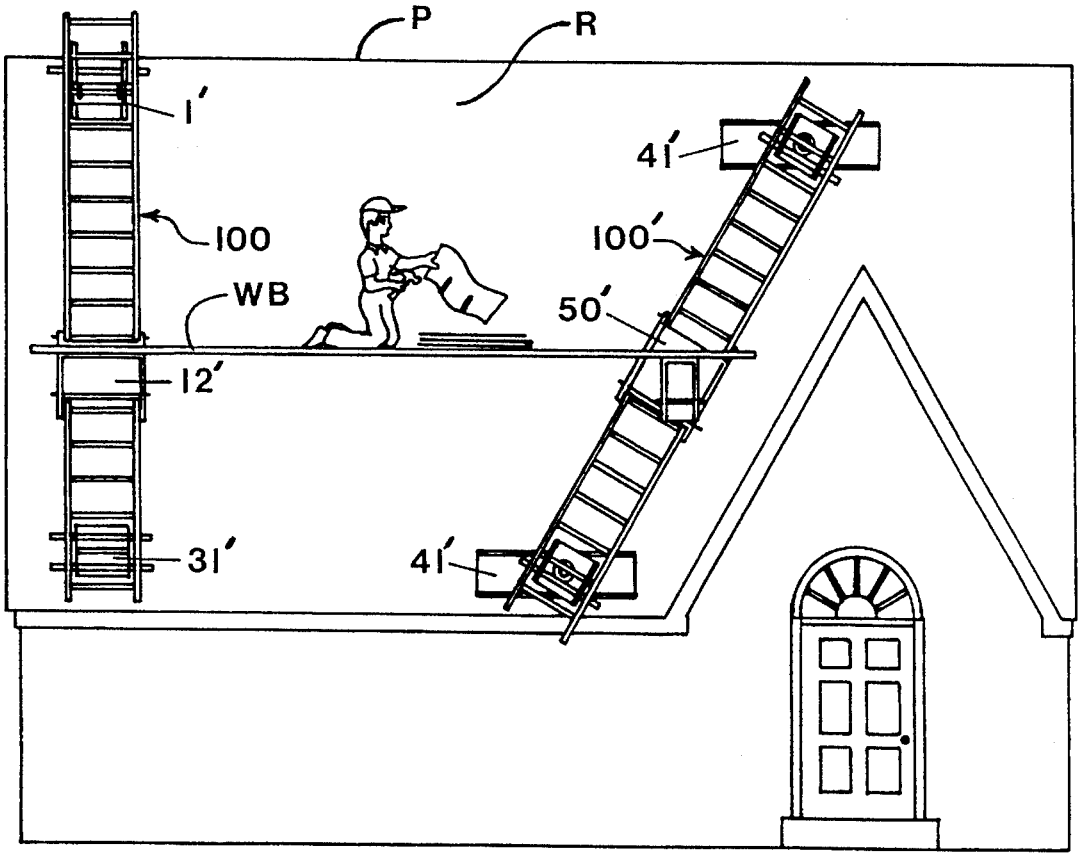

FIG. 20 illustrates how all five component parts of the portable roof scaffold system would appear in actual use on a sloped roof surface or roof framework. The combination transport/hook/standoff device 1', the fixed-direction ladder platform 12', the fixed-direction roof ladder standoff 31', two multi-directional roof ladder standoffs 41', and the multi-directional ladder platform 50'. A walkboard WB is shown suspended between the fixed direction platform 12' and the multi-direction platform 50'. The ladder 100 is shown parallel to the direction of slope of the roof, while the ladder 100' is shown skewed to the slope of the roof, but parallel to a valley formed by intersection of the roof with an adjacent section of the roof over the door of the house.

I claim:

1. Ladder apparatus for use on a sloped roof structure, the ladder apparatus comprising:

a ladder including a pair of generally parallel, longitudinally extending side rails interconnected by longitudinally spaced rungs, the ladder having first and second ends;

a first standoff including a ladder mount portion mounting the first standoff on the ladder at a location closer to the first end than the second end of the ladder, and support means spaced from the ladder mount portion and capable of engaging the sloped roof structure at a distance from the ladder;

a second standoff including a ladder mount portion mounting the second standoff on the ladder at a location spaced from the first standoff toward the second end of the ladder, and support means disposed for engaging the sloped roof structure a substantial distance from the ladder;

the first and second standoffs being arranged on the ladder for cooperating to support the ladder on the sloped roof structure at a location spaced generally above the sloped roof structure;

said support means of the first and second standoffs each comprising a support bar extending laterally outwardly from the standoff for engagement with spaced apart rafters of the sloped roof structure for supporting the ladder between the rafters;

the first standoff further including a securement portion constructed for securing the ladder on the sloped roof structure, and wherein the ladder mount portion of the first standoff mounts the first standoff for pivoting with respect to the ladder generally about the ladder mount portion between a first position in which the securement portion of the first standoff is out of position for engaging the sloped roof structure to secure the ladder and a second position in which the securement portion is in position for engaging the sloped roof structure to secure the ladder on the sloped roof structure.

2. Ladder apparatus as set forth in claim 1 wherein said support means of the first standoff further comprises a flat, smooth plate adapted to engage the sloped roof structure over a large area of the plate.

3. Ladder apparatus as set forth in claim 1 further comprising a platform including a ladder mount portion mounting the platform on the ladder for sliding motion generally longitudinally of the ladder, a releasable locking mechanism for selectively locking the platform at a longitudinal position along the ladder, the locking mechanism being adapted to pivot out of the way of the rungs of the ladder when engaged thereby upon movement of the platform in a first longitudinal direction along the ladder and being adapted to hold the platform by engagement with one of the rungs upon movement of the platform in a second longitudinal direction opposite the first direction.

4. Ladder apparatus for use on a sloped roof structure, the ladder apparatus comprising:

a ladder including a pair of generally parallel, longitudinally extending side rails interconnected by longitudinally spaced rungs, the ladder having first and second ends;

a first standoff including a ladder mount portion mounting the first standoff on the ladder at a location closer to the first end than the second end of the ladder, and support means spaced from the ladder mount portion and capable of engaging the sloped roof structure at a distance from the ladder;

a second standoff including a ladder mount portion mounting the second standoff on the ladder at a location spaced from the first standoff toward the second end of the ladder, and support means disposed for engaging the sloped roof structure a substantial distance from the ladder;

the first and second standoffs being arranged on the ladder for cooperating to support the ladder on the sloped roof structure at a location spaced generally above the sloped roof structure;

the ladder mount portion of the first standoff being connected to said support means of the first standoff for pivoting of the ladder mount portion relative to said support means for use in supporting the ladder in a skewed position on the roof.

5. Ladder apparatus as set forth in claim 4 wherein the ladder mount portion of the first standoff comprising means for releasably locking the ladder mount portion in a fixed angular position relative to said support means of the first standoff.

6. Ladder apparatus as set forth in claim 5 wherein said support means comprises a base having a flat, smooth lower surface engageable with the sloped roof structure over a large area of the lower surface, and wherein the first standoff further comprises a securement portion constructed for securing the ladder on the sloped roof structure, the securement portion of the first standoff comprises a plurality of holes in the lower surface of the base adapted to receive fasteners for securing the base to the sloped roof structure.

7. Ladder apparatus as set forth in claim 4 further comprising a platform including a ladder mount portion mounting the platform on the ladder for sliding motion generally longitudinally of the ladder, a releasable locking mechanism for selectively locking the platform at a longitudinal position along the ladder, the locking mechanism being adapted to pivot out of the way of the rungs of the ladder when engaged thereby upon movement of the platform in a first longitudinal direction along the ladder and being adapted to hold the platform by engagement with one of the rungs upon movement of the platform in a second longitudinal direction opposite the first direction.

8. Ladder apparatus for use on a sloped roof structure, the ladder apparatus comprising:

a ladder including a pair of generally parallel, longitudinally extending side rails interconnected by longitudinally spaced rungs, the ladder having first and second ends;

a first standoff including a ladder mount portion mounting the first standoff on the ladder at a location closer to the first end than the second end of the ladder, and support means spaced from the ladder mount portion and capable of engaging the sloped roof structure at a distance from the ladder;

a second standoff including a ladder mount portion mounting the second standoff on the ladder at a location spaced from the first standoff toward the second end of the ladder, and support means disposed for engaging the sloped roof structure a substantial distance from the ladder;

the first and second standoffs being arranged on the ladder for cooperating to support the ladder on the sloped roof structure at a location spaced generally above the sloped roof structure;

a platform including a ladder mount portion mounting the platform on the ladder for sliding motion generally longitudinally of the ladder, a releasable locking mechanism for selectively locking the platform at a longitudinal position along the ladder, the locking mechanism being adapted to pivot out of the way of the rungs of the ladder when engaged thereby upon movement of the platform in a first longitudinal direction along the ladder and being adapted to hold the platform by engagement with one of the rungs upon movement of the platform in a second longitudinal direction opposite the first direction.

9. Ladder apparatus as set forth in claim 8 wherein the locking mechanism comprises a lock lever mounted on the platform for pivoting about an axis extending generally transversely of the ladder and disposed for engagement with the rungs of the ladder, and a stop mounted on the platform for engaging the lock lever upon pivoting motion of the lever in one direction to hold the lock lever from further pivoting motion in said one direction.

10. Ladder apparatus as set forth in claim 8 wherein the platform comprises a first support and a second support pivotally connected to the platform generally at one end of the second support, the first support adapted for selective connection to the platform and second support at locations along its length for holding the second support in a fixed position extending away from the ladder for providing a substantially level surface when the ladder is on the sloped roof structure.

11. Ladder apparatus as set forth in claim 10 wherein the platform further comprises a support base to which the first and second supports are pivotally connected, the support base being pivotally attached to the platform, and means for releasably locking the support base in a selected angular position relative to the platform.

12. Ladder apparatus as set forth in claim 8 wherein the first standoff further includes a securement portion constructed for securing the ladder on the sloped roof structure, and wherein the ladder mount portion of the first standoff mounts the first standoff for pivoting with respect to the ladder generally about the ladder mount portion between a first position in which the securement portion of the first standoff is out of position for engaging the sloped roof structure to secure the ladder and a second position in which the securement portion is in position for engaging the sloped roof structure to secure the ladder on the sloped roof structure.

13. Ladder apparatus as set forth in claim 8 wherein said support means of the first standoff further comprises a flat, smooth plate adapted to engage the sloped roof structure over a large area of the plate.

14. Ladder apparatus for use on a sloped roof structure, the ladder apparatus comprising:

a ladder including a pair of generally parallel, longitudinally extending side rails interconnected by longitudinally spaced rungs, the ladder having first and second ends;

a first standoff including a ladder mount portion mounting the first standoff on the ladder at a location closer to the first end than the second end of the ladder, a securement portion constructed for securing the ladder on the sloped roof structure to hold the ladder from sliding down the sloped roof structure, and support means spaced from the ladder mount portion and capable of engaging the sloped roof structure at a distance from the ladder;

a second standoff including a ladder mount portion mounting the second standoff on the ladder at a location spaced from the first standoff toward the second end of the ladder, and support means disposed for engaging the sloped roof structure a substantial distance from the ladder;

the first and second standoffs being arranged on the ladder for cooperating to support the ladder on the sloped roof structure at a location spaced generally above the sloped roof structure;

the ladder mount portion of the first standoff mounting the first standoff for pivoting with respect to the ladder generally about the ladder mount portion between a first position in which the securement portion of the first standoff is out of position for engaging the sloped roof structure to secure the ladder and a second position in which the securement portion is in position for engaging the sloped roof structure to secure the ladder on the sloped roof structure;

the first ladder mount portion of the first standoff being located eccentrically with respect to the center of mass of the first standoff such that the first standoff is biased toward said second position when the ladder apparatus is generally parallel to the sloped roof structure.

15. Ladder apparatus as set forth in claim 14 wherein the securement portion is generally hook shaped, the securement portion being constructed for hooking a portion of the sloped roof structure to hold the ladder from sliding down the sloped roof structure.

16. Ladder apparatus as set forth in claim 14 wherein the first standoff further comprises wheel means disposed for engaging the sloped roof structure in said second position of the first standoff and disposed out of position for engaging the sloped roof structure in the first position.

* * * * *